US009833052B2

(12) United States Patent
Selvi

(10) Patent No.: US 9,833,052 B2
(45) Date of Patent: Dec. 5, 2017

(54) SUITCASE AND METHOD OF MANUFACTURE THEREOF

(71) Applicant: IT LUGGAGE LIMITED, Harlow, Essex (GB)

(72) Inventor: Sedat Selvi, London (GB)

(73) Assignee: IT Luggage Limited, Essex (GB)

( * ) Notice: Subject to any disclaimer, the term of this patent is extended or adjusted under 35 U.S.C. 154(b) by 0 days.

(21) Appl. No.: 14/781,422

(22) PCT Filed: Apr. 3, 2014

(86) PCT No.: PCT/GB2014/051045
§ 371 (c)(1),
(2) Date: Sep. 30, 2015

(87) PCT Pub. No.: WO2014/162138
PCT Pub. Date: Oct. 9, 2014

(65) Prior Publication Data

US 2016/0022002 A1 Jan. 28, 2016

(30) Foreign Application Priority Data

Apr. 3, 2013 (GB) ..... 1305980.3

(51) Int. Cl.
*A45C 13/26* (2006.01)
*A45C 5/14* (2006.01)
*A45C 5/03* (2006.01)

(52) U.S. Cl.
CPC ..... *A45C 13/262* (2013.01); *A45C 5/03* (2013.01); *A45C 5/14* (2013.01); *A45C 2013/265* (2013.01)

(58) Field of Classification Search
CPC .. A45C 13/262; A45C 2013/265; A45C 13/26
(Continued)

(56) References Cited

U.S. PATENT DOCUMENTS 2,392,926 A * 1/1946 Kelly ..... A45C 13/262 190/115
3,799,568 A * 3/1974 Hager ..... A45C 13/26 16/113.1
(Continued)

FOREIGN PATENT DOCUMENTS

EP 0286983 10/1988
FR 2708434 2/1995
(Continued)

OTHER PUBLICATIONS

PCT Search Report and Written Opinion for PCT/GB2014/051045, completed Jun. 17, 2013.

*Primary Examiner* — Sue A Weaver
(74) *Attorney, Agent, or Firm* — Barnes & Thornburg LLP

(57) ABSTRACT

A suitcase is disclosed comprising a first load container section defining at least a first part of a volume for receiving a load and a second container section for cooperation with the base load container section to enclose the volume. The suitcase comprises a base region provided with one or more wheel assemblies, and an upper region at or on which is provided a towing handle (30) adapted to be moved about a single point of contact (32) between a stowed position and a deployed position. This construction provides a towing handle that has the advantages provided by allowing for towing of a wheeled suitcase, while eliminating or at least mitigating the disadvantages of telescopic towing handle arrangements.

14 Claims, 4 Drawing Sheets

(58) Field of Classification Search
USPC ..... 190/100, 115
See application file for complete search history.

(56) References Cited

U.S. PATENT DOCUMENTS 3,805,929 A 4/1974 Kuwayama
4,561,526 A * 12/1985 Winter ..... A45C 13/262 16/113.1
4,838,396 A * 6/1989 Krenzel ..... A45C 13/262 190/115
5,075,925 A 12/1991 Maloney
5,464,081 A * 11/1995 Zwanzig ..... A45C 13/262 16/113.1
5,547,053 A * 8/1996 Liang ..... A45C 13/262 16/113.1
5,562,189 A * 10/1996 Chen ..... A45C 13/262 190/115
5,579,877 A * 12/1996 Homayoon ..... A45C 5/14 16/113.1
5,992,588 A * 11/1999 Morszeck ..... A45C 5/14 190/115
6,148,971 A * 11/2000 Kho ..... A45C 5/14 190/115
8,307,500 B2 * 11/2012 Gonzales ..... A45C 13/262 16/113.1
2005/0126873 A1 * 6/2005 Matsumoto ..... A45C 13/26 190/115
2011/0000754 A1 * 1/2011 Chauhan et al. .... A45C 13/262 190/18 A

FOREIGN PATENT DOCUMENTS

GB 212352 3/1924
GB 2111465 7/1983
WO WO88/06416 9/1988

* cited by examiner

SUITCASE AND METHOD OF MANUFACTURE THEREOF

CROSS-REFERENCE TO RELATED APPLICATIONS

This application is a national stage entry under 35 USC §371(b) of PCT International Application No. PCT/GB2014/051045, filed Apr. 3, 2014, and claims the benefit of United Kingdom Patent Application No. 1305980.3, filed on Apr. 3, 2013, both of which are expressly incorporated by reference herein.

BACKGROUND

The present invention relates to a suitcase and a method of manufacture thereof, in particular, but not exclusively wherein the contents of the suitcase are protected from wear and tear.

The term luggage refers to any number of bags, suitcases and/or containers which hold a traveler's articles during transit. Luggage has changed over time. Historically, the most common types of luggage were chests or trunks. In more recent times, smaller and more lightweight suitcases and bags that can be carried by an individual have become the main forms of luggage.

A suitcase is a general item that may be wheeled or non-wheeled luggage, as well as soft or hard sided baggage. A suitcase is often a somewhat flat, generally rectangular shaped item with rounded or square corners and is made from materials that more or less keep their intended shape. Many modern suitcases have a built in set or sets of wheels enabling them to be pulled along flat hard surfaces, most commonly by an extendable telescopic towing handle. The extendable towing handle is conveniently moveable between a retracted stowage position and an extended user towing position.

It is a convenient and commercially conventional practice to define a 'hard' suitcase as one in which the walls, top and bottom of the suitcase cannot easily be penetrated by a needle or blade, whereas a 'soft' suitcase is one than can be readily so penetrated.

Suitcases are often used by travelers on airlines. As is well known airlines impose a weight limit that each passenger may check in without attracting a surcharge. As such, whether in relation to hard or soft suitcases, it is a commercial imperative to ensure that as much as possible of this weight allowance is borne by the contents of the suitcase and is not due to the suitcase itself.

It is a related requirement that as large a portion of the volume of a suitcase should be free for the use of the traveler as possible. However, a common means of construction of the telescopic towing handle is to mount a pair of receiving tubes within the body of the suitcase, secured by way of a base panel of the suitcase, and extending to or through an upper panel of the suitcase, and to slidably locate a pair of tubes, which make up the side limbs of a U-shaped handle assembly forming the extendable towing handle, within the receiving tubes. In practice, while providing for a robust construction, the presence of these tubes adds considerably to the overall weight of the suitcase and reduces the interior volume of the suitcase available for use by a user of the suitcase.

Accordingly, there is need for a towing handle that has the advantages provided by allowing for towing of a wheeled suitcase, while eliminating or at least mitigating the disadvantages of telescopic towing handle arrangements.

SUMMARY

It is an advantage of the present invention that it provides a suitcase and a manner of manufacture of such a suitcase that addresses these problems. Other advantages of the present invention will also be apparent from the following description.

According to a first aspect of the present invention, a suitcase comprises a first load container section defining at least a first part of a volume for receiving a load and a second container section for cooperation with the base load container section to enclose the volume wherein the suitcase comprises a base region provided with one or more wheel assemblies, in which the suitcase further comprises an upper region at or on which is provided a towing handle adapted to be moved about a single point of contact between a stowed position and a deployed position.

Preferably, the towing handle is connected at one end to the single point of contact.

Preferably an end of the towing handle remote from the single point of contact is provided with a grip portion.

Preferably the towing handle may be secured in either the stowed position or the deployed position.

Preferably, in the stowed position the towing handle is received within a recess provided in one of the first or second container sections.

More preferably, the towing handle is substantially L-shaped. More preferably the recess is substantially L-shaped.

Alternatively, in the stowed position the grip portion of the towing handle rests or is disposed against the upper section of the suitcase. Alternatively, in the stowed position the grip portion of the towing handle is disposed substantially orthogonally to an upper surface of the suitcase.

According to a second aspect of the invention, a method of manufacture of a suitcase comprises forming a first load container section defining at least a first part of a volume for receiving a load, forming a second container section for cooperation with the base load container section to enclose the volume, securing one or more wheel assemblies to a base region of the volume, and further providing at or on an upper region of the volume a towing handle adapted to be moved about a single point of contact between a stowed position and a deployed position.

BRIEF DESCRIPTION OF THE DRAWINGS

The invention will now be described, by way of example only, with reference to the accompanying drawings, in which.

DETAILED DESCRIPTION

Figure 1:
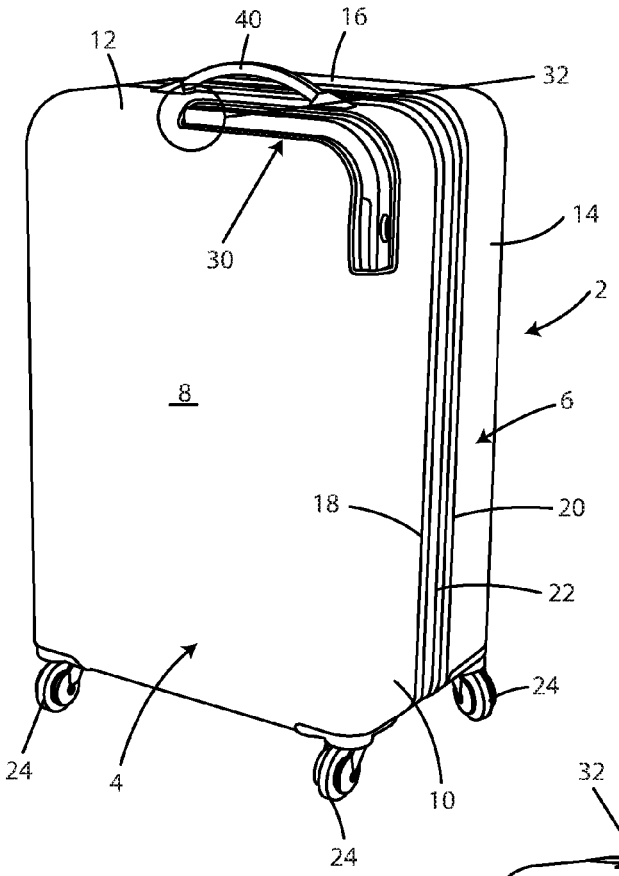
FIG. 1 shows a perspective view of a suitcase in accordance with a first embodiment of the present invention with a towing handle in a stowed position.

Referring first to FIG. 1 there is shown a schematic view of a suitcase 2 in accordance with a first embodiment of the present invention. The suitcase 2 comprises a first load container section 4 defining at least a first part of a volume for receiving a load and a second container section 6 for cooperation with the base load section to enclose the volume. The first container section 4 can be seen to comprise a main face 8, a lower face (not shown), side walls 10 and an upper face 12. The second container section 6 can similarly be seen to comprise a main face (not shown), a lower face (not shown), side walls 14 and an upper face 16. The first and second container sections 4,6 are preferably moulded from a plastics material such as acrylonitrile butadiene styrene (ABS) and include smooth curved transitional surfaces between the connecting surfaces.

The first and second container sections 4,6 are intended to connect one with the other when the suitcase is closed, as is shown in the Figures, and the first and second container sections 4,6 are each formed with complementary profiled stiffening ribs 18,20. The first and second container sections 4,6 are hindgedly connected at one edge to one another by a suitable hinge arrangement (not shown) and releasably held in a closed condition by a suitable zip fastener arrangement 22 in a manner known to those skilled in the art.

It can be seen that the lower faces of the first and second container sections 4,6 together provide for a base region of the suitcase 2. The base region is provided in any suitable manner with four wheel assemblies 22, one at each lower corner of the suitcase 2.

Figure 2:
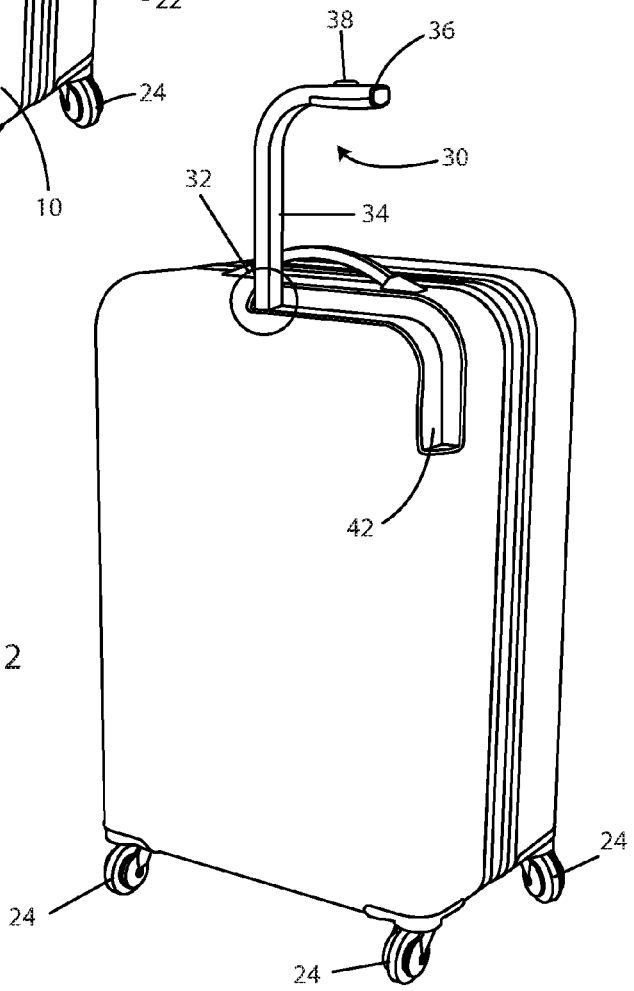
FIG. 2 shows a perspective view of the suitcase of FIG. 1 with the towing handle in a deployed position.

The upper faces 12,16 of the first and second container sections 4,6 provide for an upper region of the suitcase 2. A towing handle 30 is provided at an upper surface of the upper region. The towing handle 30 is adapted to be moved about a single point of contact 32 between a stowed position (FIG. 1) and a deployed position (FIG. 2). A lifting or carrying handle 40 may also be provided on the upper surface. The towing handle 30 may be secured to the single point of contact 32 in any suitable manner to allow movement of the towing handle 30 between each of the stowed position and the deployed position, for example by a hinge or by a ball joint.

It can be seen that the single point of contact 32 is located centrally at the rear of the upper face 12.

In the illustrated embodiment, the towing handle 30 comprises a substantially L-shaped member, a first limb 34 of which is hingedly or pivotally connected at one end to the first container section and a second limb 36 of which is provided with a grip portion. Preferably, the grip portion is provided with a shaped portion by which a user may conveniently grasp the towing handle when towing the suitcase, as well as manoeuvre the towing handle 30 between each of the stowed position and the deployed position.

The first limb 34 and the second limb 36 are provided at a fixed angle to one another. Conveniently this is achieved by forming the towing handle 30 of unitary construction.

The first limb 34 and the second limb 36 are each rigid or substantially rigid. Conveniently this may be achieved by forming the towing handle 30 from a plastics or other suitable material.

In an alternative embodiment (not shown) the first limb 34 may be formed of nested tubes allowing the first limb 34 to be telescopic in nature.

The towing handle 30 may be provided with suitable releasable securing means to secure the towing handle 30 in one or both of the stowed position and the deployed position. Conveniently the releasable securing means may be actuated by a button 38 on or adjacent to the grip portion. Alternatively, the releasable securing means may comprise a clip or other moulding provided on the suitcase to releasably retain the towing handle 30 in the stowed position.

In this embodiment, it can be seen that in the stowed position the towing handle 30 sits in a suitably shaped recess 42, either flush with the surfaces of the first container section or alternatively set back therefrom, such that when stowed the towing handle 30 is protected from damage, and in particular the single point of contact between the towing handle 30 and the suitcase 2 is protected from impact. It can be seen that a flat substantially vertical surface of the recess 42 also serves to prevent the towing handle 30 from moving other than in a single plane between the stowed position and the deployed position.

In comparison to known constructions having a telescopic towing assembly including receiving tubes extending with a load receiving volume, the present invention provides weight savings—as the need to provide the tubes to provide a telescopic towing handle assembly is eliminated—and provides additional interior volume available for use within the suitcase by a user—as the tubes of a telescopic handle assembly are no longer present within the suitcase. The embodiment of FIGS. 1 and 2 still has the relatively minor disadvantage that the recess 42 formed on the first container section comes at the cost of space within the first container section being used by the moulding forming the recess 42. This is addressed in the following embodiments.

Figure 3:
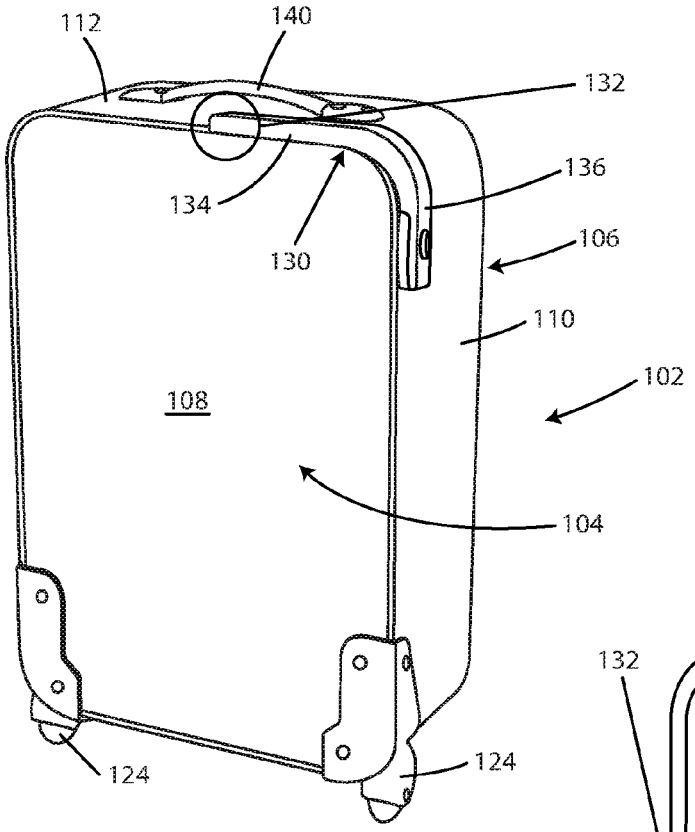
FIG. 3 shows a perspective view of a suitcase in accordance with a second embodiment of the present invention with a towing handle in a stowed position.
Figure 4:
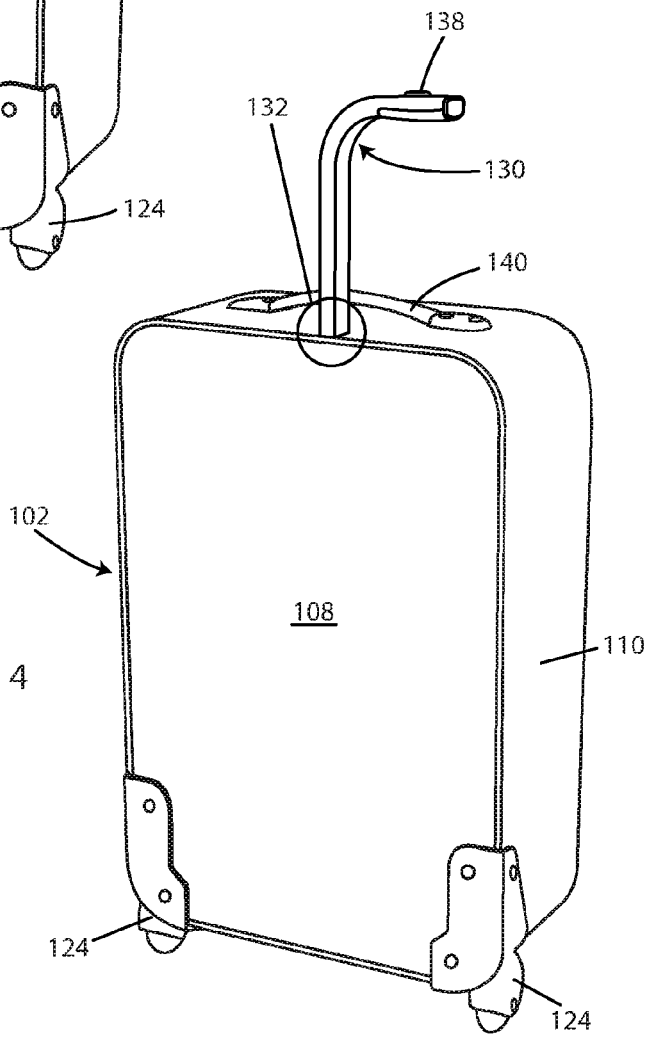
FIG. 4 shows a perspective view of the suitcase of FIG. 3 with the towing handle in a deployed position.

A second embodiment of the invention is shown in FIGS. 3 and 4. Like reference numerals will be used to refer to like features. In this embodiment the suitcase 102 is not formed from moulded shells, but comprises a series of panels stitched together to form the suitcase. The suitcase may be provided with a framework within the suitcase to support the panels. Typically the suitcase comprises a first load container or base section 104 defining at least a first part of a volume for receiving a load and a second section or lid 106 for cooperation with the base load section to enclose the volume. The first and second container sections 104,106 are hindgedly connected at one edge to one another by a suitable hinge arrangement (not shown) and releasably held in a closed condition by a suitable zip fastener arrangement in a manner known to those skilled in the art.

The first container section 104 can be seen to comprise a main face 108, a lower face (not shown), side walls 110 and an upper face 112. It can be seen that the lower face of the first container section provides for a base region to which two wheel assemblies 124 have been attached in any suitable manner to provide means to pivot the suitcase about a lower edge to enable towing of the suitcase. Further wheel assemblies or feet (not shown) to support the suitcase when not being towed may be provided at other corners of the base region.

The upper region of the first container section 104 provides for an upper surface of the suitcase. A towing handle 130 is provided at the upper surface. The towing handle 130 is adapted to be moved about a single point of contact between a stowed position (FIG. 3) and a deployed position (FIG. 4). A lifting or carrying handle 140 may also be provided on the upper surface.

In the illustrated embodiment, the towing handle 130 comprises a substantially L-shaped member, a first limb 134 of which is hingedly or pivotally connected at one end to the first container section 104 and a second limb 136 of which is provided with a grip portion. Preferably, the grip portion is provided with a shaped portion by which a user may conveniently grasp the towing handle when towing the suitcase.

The towing handle 130 may be provided with releasable securing means to secure the towing handle 130 in one or both of the stowed position and deployed position. Conveniently the releasable securing means may be actuated by a button 138 on or adjacent to the grip portion.

In this embodiment, it can be seen that an internal surface following the limbs 134,136 of the towing handle 130 fits around external dimensions of the suitcase 102, such that in the stowed position the grip portion of the towing handle 130 follows and sits adjacent the side wall 110 of the first container section 104.

Figure 5:
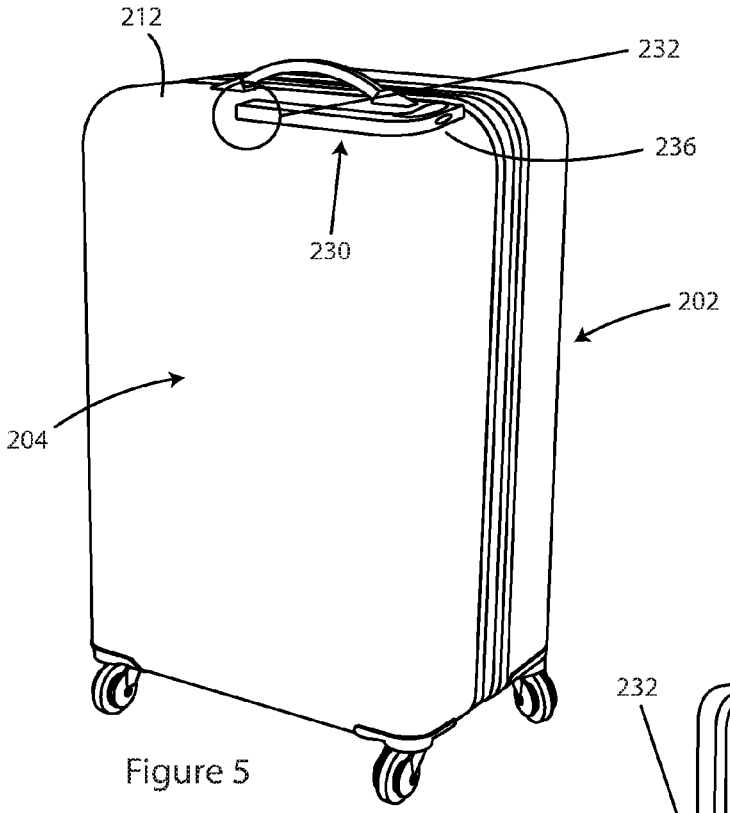
FIG. 5 shows a perspective view of a suitcase in accordance with a third embodiment of the present invention with a towing handle in a stowed position.
Figure 6:
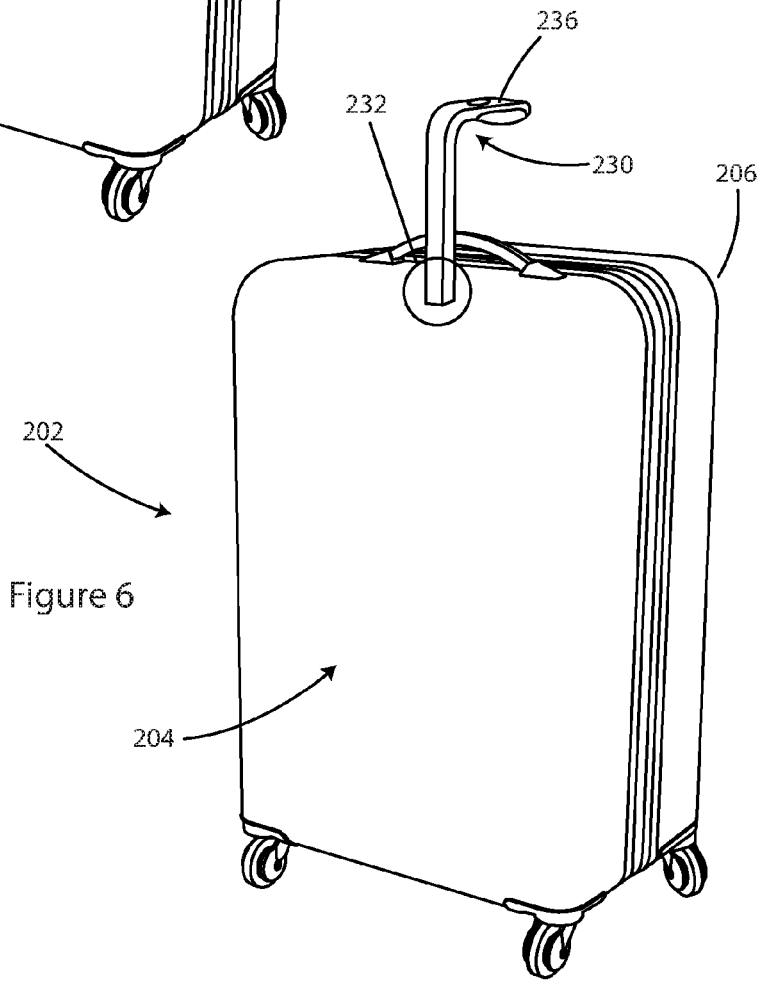
FIG. 6 shows a perspective view of the suitcase of FIG. 5 with the towing handle in a deployed position.

A third embodiment of the invention is shown in FIGS. 5 and 6. Like reference numerals will be used to refer to like features. The suitcase of FIGS. 5 and 6 is a moulded suitcase 202 similar to that of FIGS. 1 and 2. In this embodiment, the towing handle 230 sits upon an upper region of the suitcase 202 such that in the stowed position the towing handle 230 lies flat within a footprint defined by the upper surface of the suitcase 202. In particular in the stowed position a second limb 236 of the towing handle 230 lies flat on the upper face 212 of the first container section 204.

Figure 7:
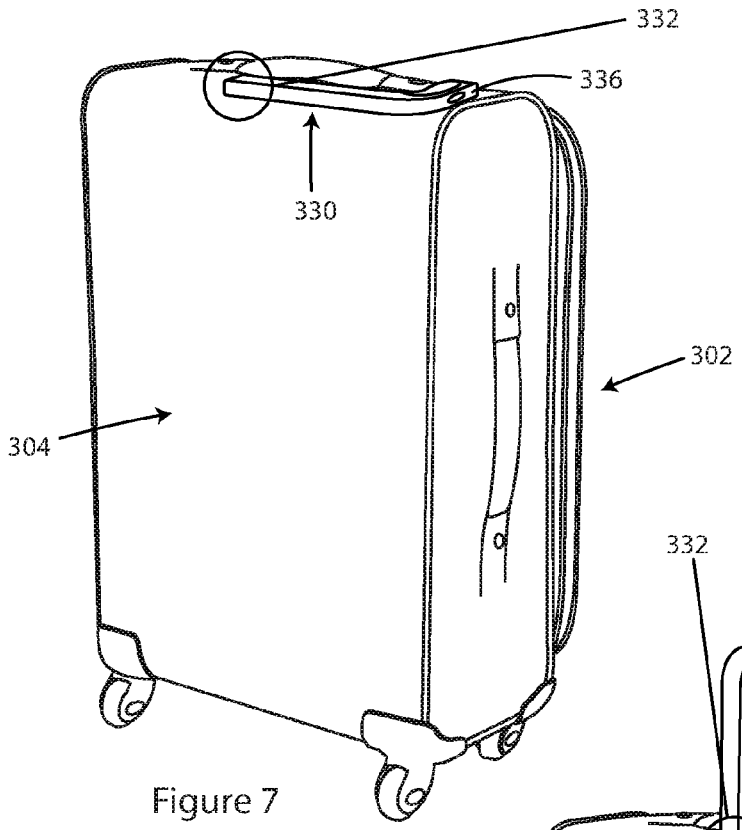
FIG. 7 shows a perspective view of a suitcase in accordance with a fourth embodiment of the present invention with a towing handle in a stowed position.
Figure 8:
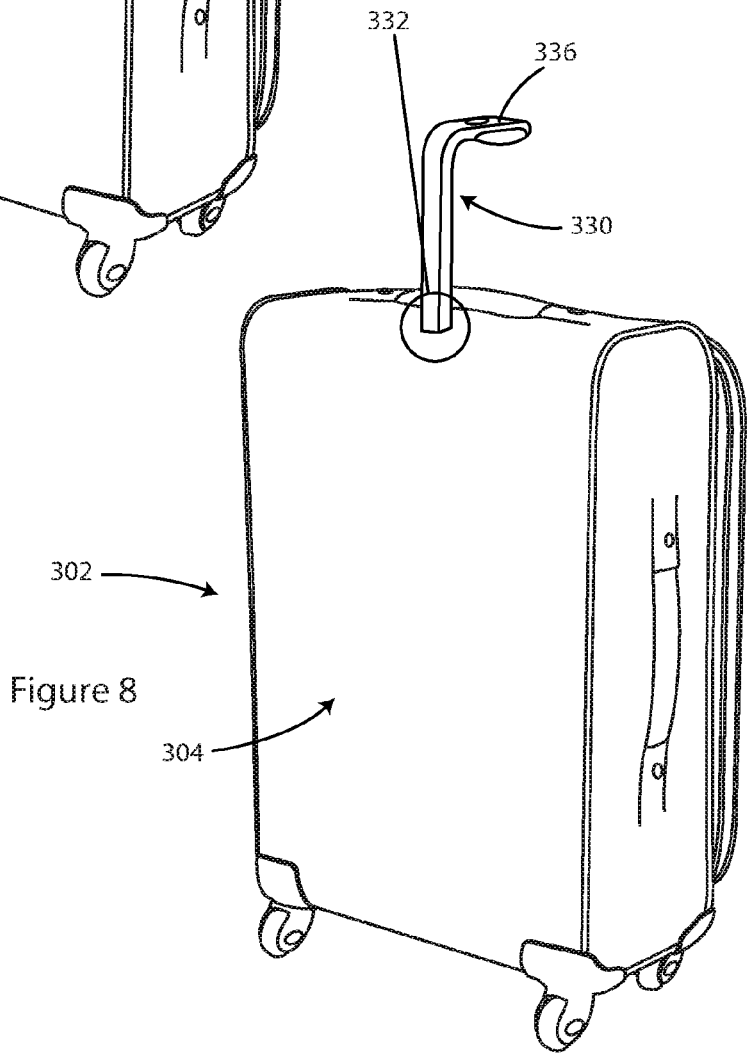
FIG. 8 shows a perspective view of the suitcase of FIG. 7 with the towing handle in a deployed position.

A fourth embodiment of the invention is shown in FIGS. 7 and 8. Like reference numerals will be used to refer to like features. The suitcase 302 of FIGS. 7 and 8 is, like the embodiment of FIGS. 3 and 4 not formed from moulded shells. In this embodiment, a towing handle 330 also sits upon the upper surface of the suitcase 302 such that in the stowed position the towing handle 330 lies flat within a footprint defined by the upper surface of the suitcase. In particular, in the stowed position a second limb 336 of the towing handle 230 lies flat on the upper face 212 of the first container section 204.

What is claimed is:

1. A suitcase comprising a first container section defining at least a first part of a volume for receiving a load and a second container section for cooperation with the first container section to enclose the volume wherein the suitcase comprises a base region provided with four wheel assemblies, one at each corner of the base region and an upper surface, in which an L-shaped towing handle is provided at or on the upper surface of the suitcase, the L-shaped towing handle being adapted to be pivoted between a stowed position and a deployed position about a portion of the first container section located about midway between opposite side walls of the first container section, wherein an L-shaped recess to receive the L-shaped towing handle has a substantially horizontal portion along a first corner region defined between a top wall and a back wall of the first container section and has a substantially vertical portion along a second corner region defined between a side wall and the back wall of the first container section; wherein when the L-shaped towing handle is in the stowed position, a first limb of the L-shaped towing handle is oriented substantially horizontally and is received in the substantially horizontal portion of the L-shaped recess and a second limb of the L-shaped towing handle is oriented substantially vertically and is received in the substantially vertical portion of the L-shaped recess; and wherein when the L-shaped towing handle is in the deployed position, the L-shaped towing handle extends upwardly out of the L-shaped recess with the first limb being oriented substantially vertically and the second limb being oriented substantially horizontally.

2. A suitcase according to claim 1, in which the L-shaped towing handle is connected to the first container section adjacent to a carrying handle that is coupled to the top wall of the first container section.

3. A suitcase according to claim 2, in which the second limb of the L-shaped towing handle serves as a grip portion when the L-shaped towing handle is in the deployed position.

4. A suitcase according to claim 1, in which, in the stowed position, the L-shaped towing handle substantially fills the L-shaped recess provided in the first container section.

5. A suitcase according to claim 4, in which the L-shaped towing handle is rounded between the first and second limbs.

6. A suitcase according to claim 5, in which the L-shaped recess is rounded between the substantially horizontal portion and the substantially vertical portion.

7. A suitcase according to claim 6, in which in the stowed position an end of the second limb of the L-shaped towing handle faces an upwardly facing surface that defines a lower end of the substantially vertical portion of the L-shaped recess.

8. A suitcase according to claim 6, in which in the stowed position, top, rear, and side outer surfaces of the L-shaped towing handle are substantially flush with respective upper, back, and side surfaces of the first container section.

9. A method of manufacture of a suitcase comprising forming a first container section defining at least a first part of a volume for receiving a load, forming a second container section for cooperation with the first container section to enclose the volume, securing four wheel assemblies to a base region of the volume, one at each corner of the base region, providing at or on an upper surface of the volume an L-shaped towing handle adapted to be pivoted between a stowed position and a deployed position about a portion of the first container section located about midway between opposite side walls of the first container section, wherein forming the first container section includes forming an L-shaped recess to receive the L-shaped towing handle having a substantially horizontal portion along a first corner region defined between a top wall and a back wall of the first container section and having a substantially vertical portion along a second corner region defined between a side wall and the back wall of the first container section; wherein when the L-shaped towing handle is in the stowed position, a first limb of the L-shaped towing handle is oriented substantially horizontally and is received in the substantially horizontal portion of the L-shaped recess and a second limb of the L-shaped towing handle is oriented substantially vertically and is received in the substantially vertical portion of the L-shaped recess; and wherein when the L-shaped towing handle is in the deployed position, the L-shaped towing handle extends upwardly out of the L-shaped recess with the first limb being oriented substantially vertically and the second limb being oriented substantially horizontally.

10. A method according to claim 9, further comprising providing a carrying handle on the top wall of the first container section adjacent to of the L-shaped towing handle.

11. A method according to claim 10, in which the second limb of the L-shaped towing handle serves as a grip portion when the L-shaped handle is in the deployed position.

12. A method according to claim 11, further comprising forming the L-shaped recess such that the L-shaped towing handle substantially fills the L-shaped recess when in the stowed position.

13. A method according to claim 12, in which the L-shaped towing handle is rounded between the first and second limbs.

14. A method according to claim 13, in which the L-shaped recess is rounded between the substantially horizontal portion and the substantially vertical portion.

* * * * *